US011351558B2

(12) United States Patent
Wang et al.

(10) Patent No.: US 11,351,558 B2
(45) Date of Patent: Jun. 7, 2022

(54) SHOWER DEVICE

(71) Applicant: Xiamen Lota International Co., Ltd., Fujian (CN)

(72) Inventors: Xuedong Wang, Fujian (CN); Jiangcheng Zhang, Fujian (CN); Zhixin Lin, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 110 days.

(21) Appl. No.: 17/034,215

(22) Filed: Sep. 28, 2020

(65) Prior Publication Data

US 2021/0094049 A1 Apr. 1, 2021

(30) Foreign Application Priority Data

Sep. 27, 2019 (CN) ..... 201921636083.8

(51) Int. Cl.
*B05B 1/16* (2006.01)
*B05B 15/652* (2018.01)
*B05B 1/18* (2006.01)

(52) U.S. Cl.
CPC ..... *B05B 1/16* (2013.01); *B05B 1/185* (2013.01); *B05B 15/652* (2018.02)

(58) Field of Classification Search
CPC ..... B05B 1/18; B05B 1/16; B05B 1/1636; B05B 1/185; B05B 15/652
See application file for complete search history.

(56) References Cited

U.S. PATENT DOCUMENTS

| | | | | |
|---|---|---|---|---|
| 7,143,961 | B1 * | 12/2006 | Wu | E03C 1/0409 239/443 |
| 9,707,574 | B2 * | 7/2017 | Soetaert | E03C 1/0408 |
| 10,046,340 | B2 * | 8/2018 | Lin | B05B 1/1681 |
| 2015/0090811 | A1 * | 4/2015 | Wu | B05B 1/169 137/625.6 |
| 2015/0090813 | A1 * | 4/2015 | Zhang | E03C 1/0409 137/625.6 |
| 2019/0366356 | A1 * | 12/2019 | Yu | E03C 1/0408 |

* cited by examiner

*Primary Examiner* — Darren W Gorman
(74) *Attorney, Agent, or Firm* — Cooper Legal Group, LLC

(57) ABSTRACT

The present disclosure provides a shower device. A first shower comprises a first water outlet passage. The joint comprises a water inlet cavity and a water outlet cavity. A second shower fixed portion comprises a first water passage, a second water passage, a first water hole, and a second water hole. The rotation switching portion is rotatably connected to the second shower fixed portion and comprises water dividing holes and a second water outlet passage. A flow gap is defined between the second shower fixed portion and the rotation switching portion. The rotation switching portion rotates to enable the first water hole to be in communication with at least one of the at least two water dividing holes. The connecting pipe comprises an outer flow passage and an inner flow passage disposed in the outer flow passage.

9 Claims, 10 Drawing Sheets

SHOWER DEVICE

RELATED APPLICATIONS

This application claims priority to Chinese patent application number 201921636083.8, filed on Sep. 27, 2019. Chinese patent application number 201921636083.8 is incorporated herein by reference.

FIELD OF THE DISCLOSURE

The present disclosure relates to a shower device.

BACKGROUND OF THE DISCLOSURE

Existing shower devices generally comprise a top shower and a handheld shower, and a switching valve is provided for switching a water passage to enable water to flow from the top shower or the handheld shower. However, the existing switching valves cannot allow water to flow out of both the top shower and the handheld shower at the same time. If water flows out of the top shower and the handheld shower at the same time, an additional structure needs to be added, resulting in the shower device being large and complicated. Additionally, the existing switching valves are mostly arranged on the top shower. Since the top shower is fixed at a higher position, it is difficult for consumers to use and operate, which affects user comfort.

BRIEF SUMMARY OF THE DISCLOSURE

The present disclosure provides a shower device to overcome the deficiencies of the existing techniques.

In order to solve the aforementioned technical problem, a technical solution of the present disclosure is as follows.

A shower device comprises a first shower with a first water outlet passage, a joint, a second shower, and a connecting pipe. The joint is fixedly connected to the first shower, and the joint comprises a water inlet cavity and a water outlet cavity. The first water outlet passage is in communication with the water outlet cavity. The second shower comprises a second shower fixed portion and a rotation switching portion. The second shower fixed portion comprises a first water passage, a second water passage disposed in the first water passage, a first water hole in communication with the first water passage, and a second water hole in communication with the second water passage. The rotation switching portion is rotatably connected to the second shower fixed portion, and the rotation switching portion comprises at least two water dividing holes and a second water outlet passage. A flow gap in communication with the second water passage is defined between the second shower fixed portion and the rotation switching portion. A first one of the at least two water dividing holes is in communication with the second water outlet passage, and a second one of the at least two water dividing holes and the second water hole are in communication with the flow gap. The rotation switching portion rotates to enable the first water hole to be switched to be in communication with at least one of the at least two water dividing holes (i.e., to be in communication with at least one of the at least two water dividing holes or to be in communication with two adjacent holes of the at least two water dividing holes concurrently). The connecting pipe comprises an outer flow passage and an inner flow passage disposed in the outer flow passage. Two ends of the connecting pipe are respectively fixedly connected to the joint and the second shower fixed portion. The outer flow passage is in communication with the water inlet cavity and the first water passage, and the inner flow passage is in communication with the second water passage and the water outlet cavity.

In a preferred embodiment, the shower device comprises a sealing pad. The second shower fixed portion comprises a second shower body and an adjusting sheet fixedly disposed in the second shower body. The first water passage and the second water passage are both disposed on the second shower body. The first water hole and the second water hole are both disposed on the adjusting sheet. A bottom surface of the adjusting sheet comprises a mounting groove in communication with the first water hole. The sealing pad is hermetically coupled in the mounting groove, and a bottom surface of the sealing pad comprises one or more sealing holes. The rotation switching portion rotates to enable the one or more sealing holes to align with and be in communication with at least one of the at least two water dividing holes or to be staggered with at least one of the at least two water dividing holes to be sealed.

In a preferred embodiment, the rotation switching portion comprises a water dividing body disposed below the adjusting sheet and a water outlet panel assembly fixedly connected to the water dividing body. The at least two water dividing holes comprise two water dividing holes, and the two water dividing holes respectively define a first water dividing hole and a second water dividing hole and are disposed on the water dividing body. The second water outlet passage is disposed on the water outlet panel assembly. The water dividing body comprises a through hole in communication with the flow gap, and a bottom surface of the water dividing body further comprises a connecting groove configured to be in communication with the second water dividing hole and the through hole.

In a preferred embodiment, the shower device comprises a sealing ring. The bottom surface of the adjusting sheet protrudes downward to define a protruding ring, a top surface of the water dividing body comprises an annular groove, and the protruding ring is disposed in the annular groove. The sealing ring is hermetically sandwiched between the protruding ring and a groove wall of the annular groove. The adjusting sheet further comprises a receiving groove. A water stopping pad and a water stopping elastic member are disposed in the receiving groove, and two ends of the water stopping elastic member abut and are disposed between a top wall of the receiving groove and the water stopping pad. When the first water dividing hole is staggered with the one or more sealing holes, the water stopping pad hermetically abuts a position of the first water dividing hole. The flow gap is defined between the sealing ring, the adjusting sheet, the water dividing body, and the water stopping pad.

In a preferred embodiment, the shower device comprises a lock bolt. The bottom surface of the adjusting sheet protrudes to define a hollow rotation shaft. The water dividing body and the water outlet panel assembly are respectively disposed with a first shaft hole and a second shaft hole. The hollow rotation shaft is disposed in the first shaft hole and the second shaft hole, and the hollow rotation shaft rotatably cooperates with the first shaft hole and the second shaft hole. The lock bolt passes through the hollow rotation shaft, a head end of the lock bolt abuts an outer side of the hollow rotation shaft, and the lock bolt is screwed to the second shower fixed portion to enable the water dividing body, the water outlet panel assembly, and the second shower fixed portion to be relatively fixed axially.

In a preferred embodiment, the shower device comprises a gearing position pin and a gearing position elastic member. The adjusting sheet further comprises a gearing position cavity. A guide column is disposed in the gearing position cavity, and the gearing position pin surrounds an outer side of the guide column. The gearing position elastic member is disposed between the gearing position pin and the guide column, and two ends of the gearing position elastic member abut and are disposed between the gearing position cavity and the gearing position pin. The top surface of the water dividing body comprises a plurality of gearing position slots configured to cooperate with the gearing position pin.

In a preferred embodiment, the water outlet panel assembly comprises a water outlet panel, an adjusting ring, and a decorative cover. The adjusting ring surrounds an outer side of the water outlet panel. The decorative cover is connected to and covers a center of the water outlet panel. The adjusting ring is disposed with a dial.

In a preferred embodiment, the shower device comprises one or more sealing elastic members, and the number of the sealing elastic members is equal to the number of the at least two sealing holes. A top portion of the sealing pad comprises a guide groove in communication with all of the one or more sealing holes, and each of the one or more sealing elastic members abuts and is disposed between a corresponding one of the one or more sealing holes and a groove wall of the mounting groove.

In a preferred embodiment, the first shower is a top shower, and the second shower is a handheld shower.

Compared with the existing techniques, the technical solution has the following advantages.

1. Since the connecting pipe of the shower device adopts a tube-in-tube structure, the first water passage and the second water passage of the second shower also have an inner pipe structure and an outer pipe structure, so the entire shower is small in size, simple in structure, and more convenient to be assembled. At the same time, the rotation switching portion is disposed in the second shower, which makes the switching of the water passage more convenient, and the first water outlet passage and the second water outlet passage can both discharge water separately or simultaneously. This switching method is more suitable for parent-children showers or matching showers.

2. The flow gap is formed between the sealing ring, the adjusting sheet, the water dividing body, and the water stopping pad. The through hole and the second water hole are connected through the flow gap, and there is no need to separately provide a water passage for connecting the through hole and the second water hole, therefore reducing the volume of the second shower.

3. The second shower is a handheld shower, which makes the waterway switching more convenient.

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
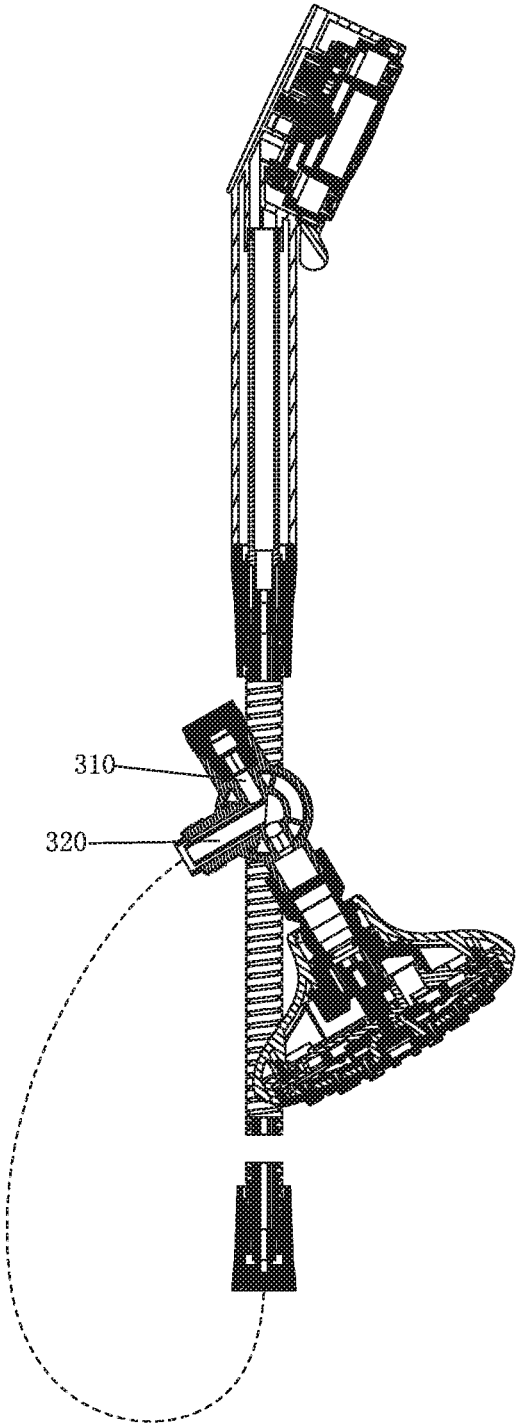
FIG. 1 illustrates a cross-sectional view of a shower device of an embodiment.
Figure 2:
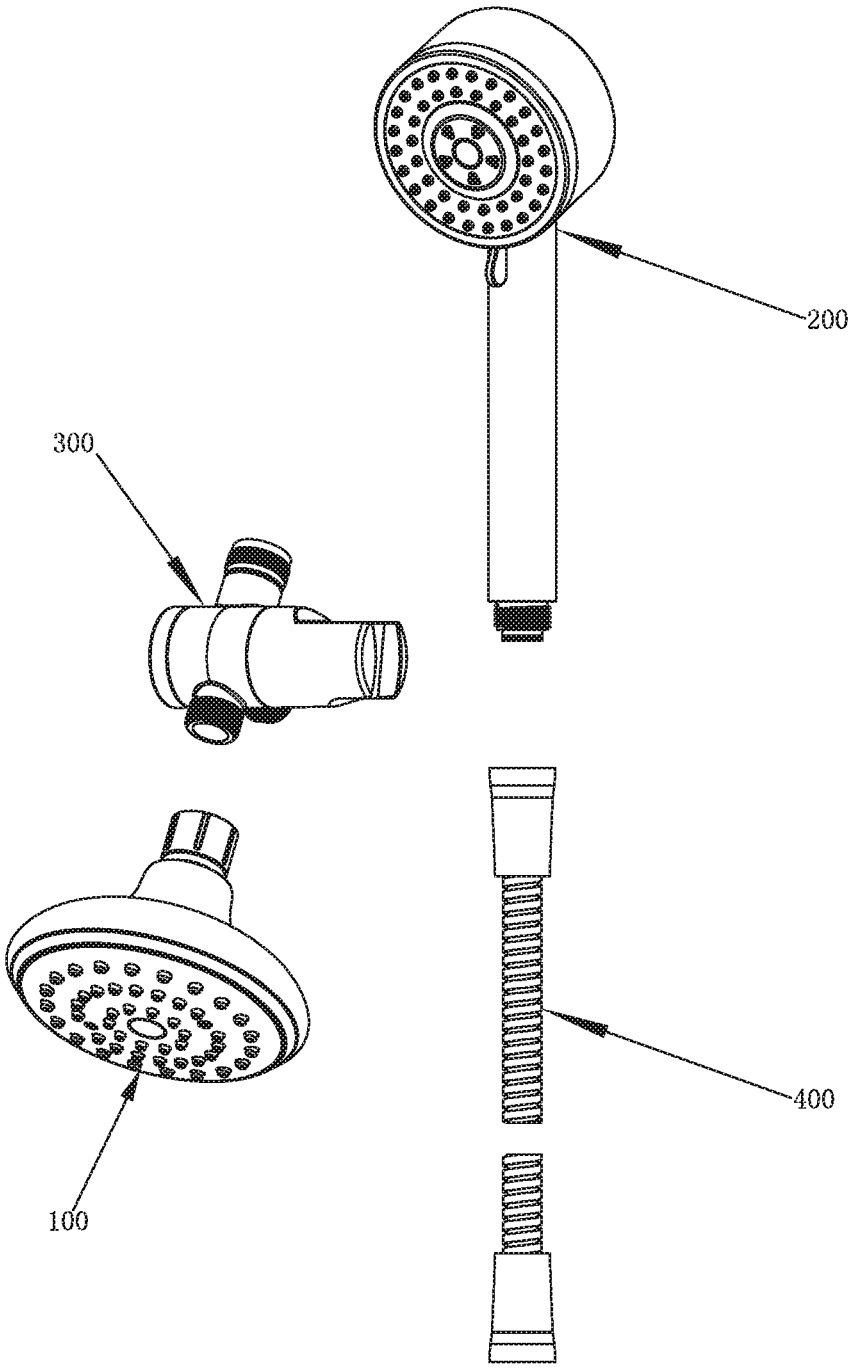
FIG. 2 illustrates an exploded perspective view of the shower device of the embodiment.

Referring to FIGS. 1-16, an embodiment of a shower device comprises a first shower 100, a joint 300, a second shower 200, and a connecting pipe 400.

In this embodiment, the first shower 100 is a top shower, and the second shower 200 is a handheld shower. In another embodiment, the first shower 100 can be a handheld shower, and the second shower 200 can be a top shower. In another embodiment, the first shower 100 and the second shower 200 can be parent-child showers or matching showers.

The first shower 100 comprises a first water outlet passage 110.

The joint 300 is fixedly connected to the first shower 100. The joint 300 comprises a water inlet cavity 310 and a water outlet cavity 320, and the first water outlet passage 110 is in communication with the water outlet cavity 320.

The second shower 200 comprises a second shower fixed portion 21 and a rotation switching portion 22. The second shower fixed portion 21 comprises a first water passage 210, a second water passage 220 disposed in the first water passage 210, a first water hole 230 in communication with the first water passage 210, and a second water hole 240 in communication with the second water passage 220. The rotation switching portion 22 is rotatably connected to the second shower fixed portion 21, and the rotation switching portion 22 comprises at least two water dividing holes 251 and 252 and a second water outlet passage 260. A flow gap 270 in communication with the second water passage 220 is defined between the second shower fixed portion 21 and the rotation switching portion 22. In this embodiment, the at least two water dividing holes 251 and 252 comprises two water dividing holes, and the two water dividing holes respectively define a first water dividing hole 251 and a second water dividing hole 252. The first water dividing hole 251 is in communication with the second water outlet passage 260, and the second water dividing hole 252 and the second water hole 240 are in communication with the flow gap 270. The rotation switching portion 22 rotates to enable the first water hole 230 to be switched to be in communication with one of the two water dividing holes 251 and 252 or both of the two water dividing holes 251 and 252 concurrently.

In this embodiment, the second shower fixed portion 21 comprises a second shower body 201 and an adjusting sheet 202 fixedly disposed in the second shower body 201. The first water passage 210 and the second water passage 220 are both disposed on the second shower body 201, and the first water hole 230 and the second water hole 240 are both disposed on the adjusting sheet 202. A bottom surface of the adjusting sheet 202 comprises a mounting groove 231 in communication with the first water hole 230. The shower device further comprises a sealing pad 232. The sealing pad 232 is hermetically coupled in the mounting groove 231, and a bottom surface of the sealing pad 232 comprises at least two sealing holes 233 and 234. The rotation switching portion 22 rotates to enable the at least two sealing holes 233 and 234 to be aligned with at least one of the at least two water dividing holes 251 and 252 to be in communication with at least one of the at least two water dividing holes 251 and 252 or to be staggered with at least one of the at least two water dividing holes 251 and 252 to be sealed.

In this embodiment, a top portion of the sealing pad 232 comprises a guide groove 235 in communication with all of the at least two sealing holes 233 and 234. The shower device further comprises sealing elastic members 236. The number of the sealing elastic members 236 is equal to the number of the at least two sealing holes 233 and 234. Each of the sealing elastic members 236 abuts and is disposed between a corresponding one of the at least two sealing holes 233 and 234 and a groove wall of the mounting groove 231. In this embodiment, the sealing pad 232 defines a circular arc shape, the at least two sealing holes 233 and 234 comprises two sealing holes 233 and 234, the at least two sealing holes 233 and 234 are disposed at intervals along an arc length direction of the sealing pad 232, and the two sealing holes 233 and 234 define a first sealing hole 233 and a second sealing hole 234.

In this embodiment, the rotation switching portion 22 comprises a water dividing body 203 disposed below the adjusting sheet 202 and a water outlet panel assembly 221 fixedly connected to the water dividing body 203. The first water dividing hole 251 and the second water dividing hole 252 are each disposed on the water dividing body 203. The second water outlet passage 260 is disposed on the water outlet panel assembly 221. The water dividing body 203 further comprises a through hole 271 in communication with the flow gap 270, and a bottom surface of the water dividing body 203 further comprises a connecting groove 272 configured to be in communication with the second water dividing hole 252 and the through hole 271.

Figure 13:
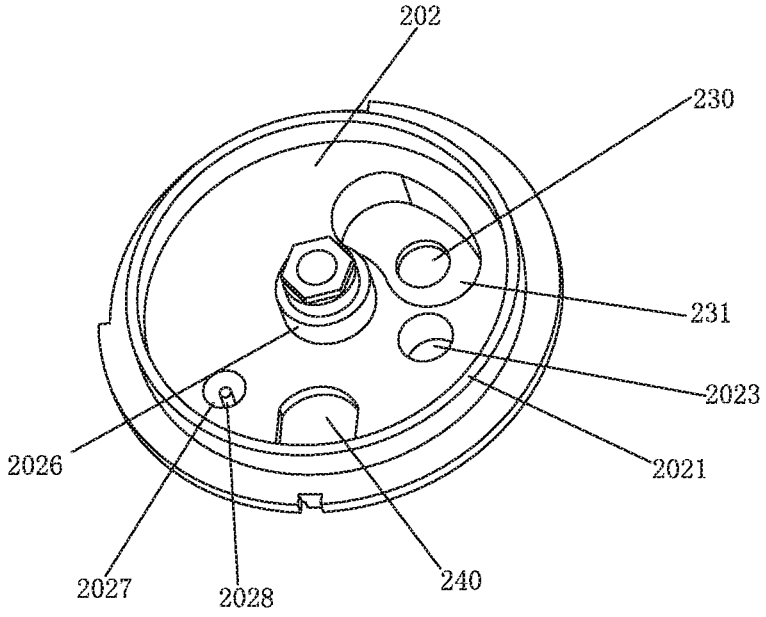
FIG. 13 illustrates a second perspective view of the adjusting sheet.
Figure 14:
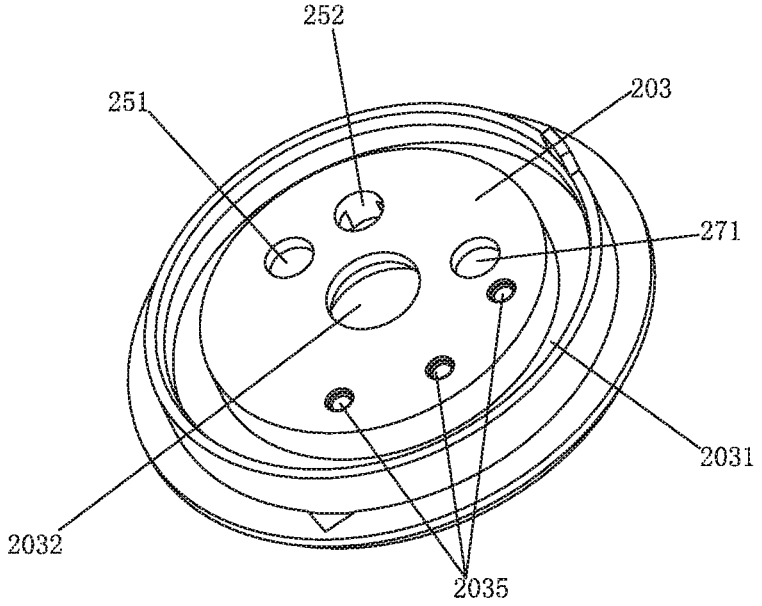
FIG. 14 illustrates a first perspective view of a water dividing body.
Figure 15:
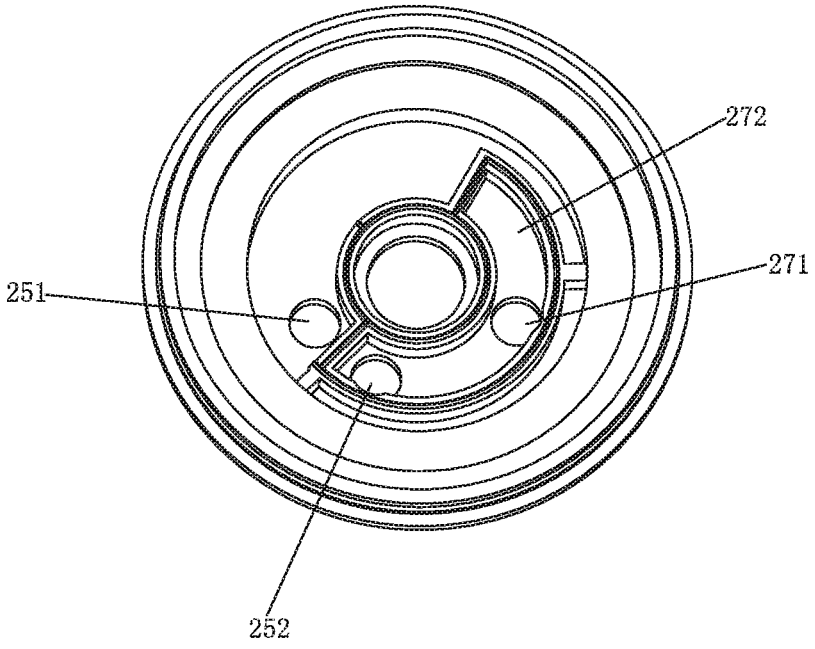
FIG. 15 illustrates a second perspective view of the water dividing body.
Figure 16:
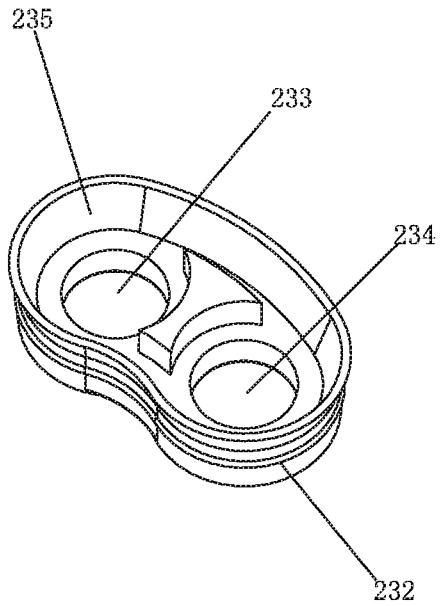
FIG. 16 illustrates a perspective view of a sealing pad.

In this embodiment, referring to FIG. 13, the bottom surface of the adjusting sheet 202 protrudes downward to define a protruding ring 2021. Referring to FIG. 14, a top surface of the water dividing body 203 comprises an annular groove 2031, and the protruding ring 2021 is disposed in the annular groove 2031. The shower device further comprises a sealing ring 2022. The sealing ring 2022 is hermetically sandwiched between the protruding ring 2021 and a groove wall of the annular groove 2031. The adjusting sheet 202 further comprises a receiving groove 2023, and a water stopping pad 2024 and a water stopping elastic member 2025 are disposed in the receiving groove 2023. Two ends of the water stopping elastic member 2025 abut and are disposed between a top wall of the receiving groove 2023 and the water stopping pad 2024. When the first water dividing hole 251 is staggered from the at least two sealing holes 233 and 234, the water stopping pad 2024 hermetically abuts a position of the first water dividing hole 251. The flow gap 270 is defined between the sealing ring 2022, the adjusting sheet 202, the water dividing body 203, and the water stopping pad 2024.

The connecting pipe 400 comprises an outer flow passage 410 and an inner flow passage 420 disposed in the outer flow passage 410. Two ends of the connecting pipe 400 are respectively fixedly connected to the joint 300 and the second shower fixed portion 21. The outer flow passage 410 is in communication with the water inlet cavity 310 and the first water passage 210, and the inner flow passage 420 is in communication with the second water passage 220 and the water outlet cavity 320.

In this embodiment, referring to FIG. 13, the bottom surface of the adjusting sheet 202 further protrudes to define a hollow rotation shaft 2026. The water dividing body 203 and the water outlet panel assembly 221 respectively comprise a first shaft hole 2032 and a second shaft hole 2033. The hollow rotation shaft 2026 is rotatably disposed in the first shaft hole 2032 and the second shaft hole 2033. The shower device further comprises a lock bolt 2034. The lock bolt 2034 passes through the hollow rotation shaft 2026, and a head end of the lock bolt 2034 abuts an outside of the hollow rotation shaft 2026. The lock bolt 2034 is screwed to the second shower fixed portion 21 to enable the water dividing body 203, the water outlet panel assembly 221, and the second shower fixed portion 21 to be relatively fixed axially. The adjusting sheet 202 is fixedly connected to the second shower body 201 by welding.

In this embodiment, the shower device further comprises a gearing position pin 10 and a gearing position elastic member 11. The adjusting sheet 202 further comprises a gearing position cavity 2027. A guide column 2028 is disposed in the gearing position cavity 2027, and the gearing position pin 10 surrounds an outer side of the guide column 2028. The gearing position elastic member 11 is disposed between the gearing position pin 10 and the guide column 2028, and two ends of the gearing position elastic member 11 abut and are disposed between the gearing position cavity 2027 and the gearing position pin 10. The top surface of the water dividing body 203 comprises a plurality of gearing position slots 2035 configured to cooperate with the gearing position pin 10. Referring to FIG. 14, the plurality of gearing position slots 2035 comprises three gearing position slots, and the three gearing position slots are annularly disposed at intervals. The gearing position pin 10 respectively couples with the three gearing position slots 2035 to define a first gearing position, a second gearing position, and a third gearing position in series.

In this embodiment, the water outlet panel assembly 221 comprises a water outlet panel 204, an adjusting ring 205, and a decorative cover 206. The adjusting ring 205 surrounds an outer side of the water outlet panel 204, and the decorative cover 206 is connected to and covers a center of the water outlet panel 204. The adjusting ring 205 is disposed with a dial 2051.

The shower device works as follows.

Figure 3:
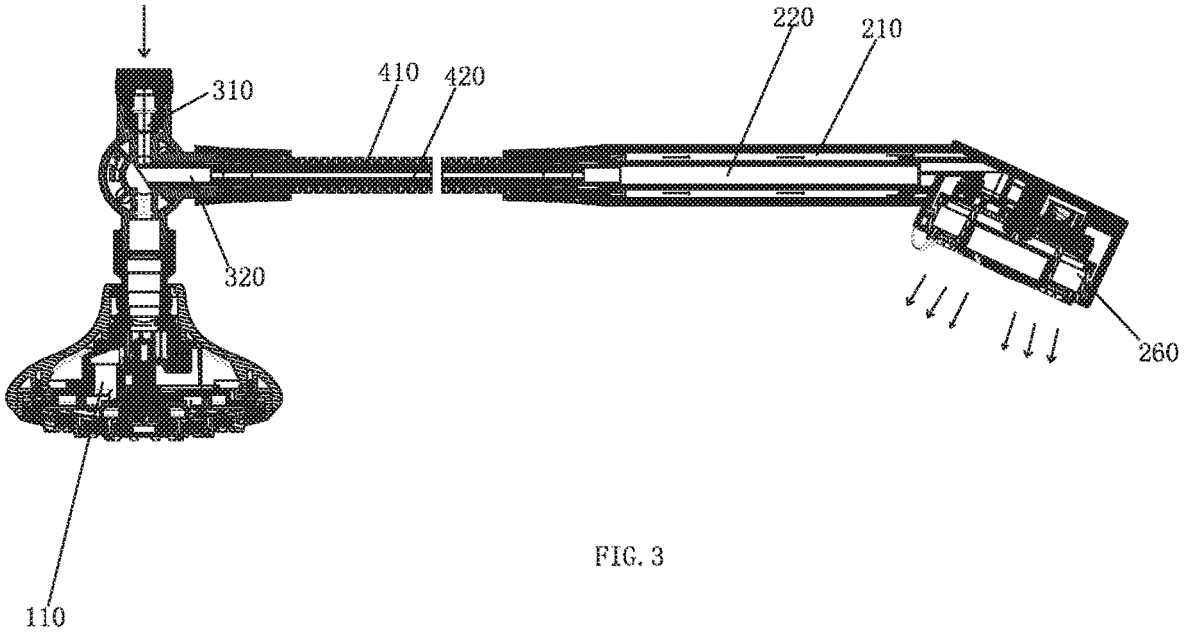
FIG. 3 illustrates a cross-sectional view of a first waterway of the shower device when in a first gearing position.
Figure 4:
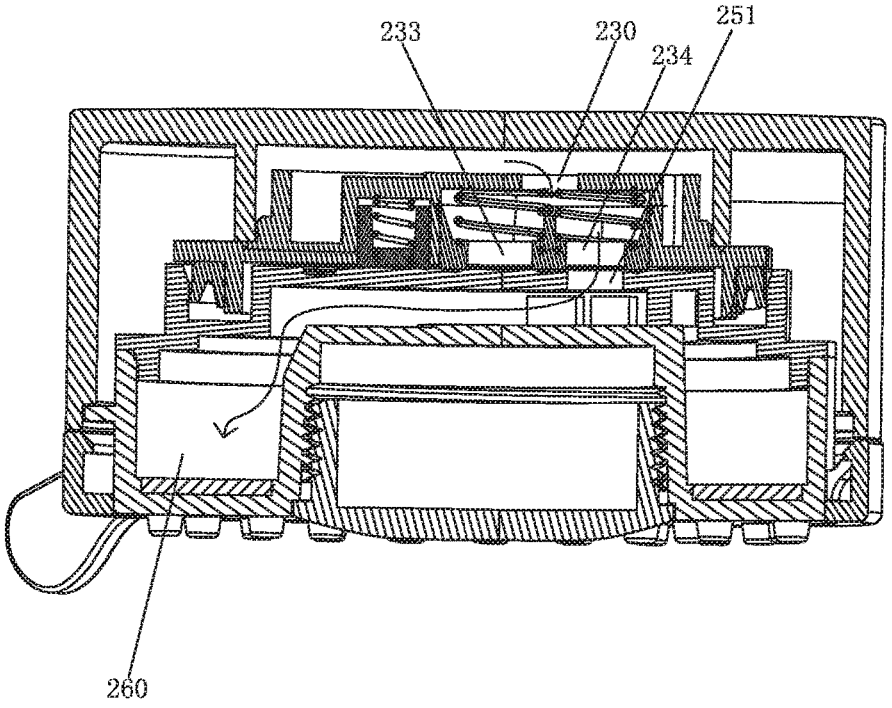
FIG. 4 illustrates a cross-sectional view of a second shower of the shower device when in the first gearing position.
Figure 5:
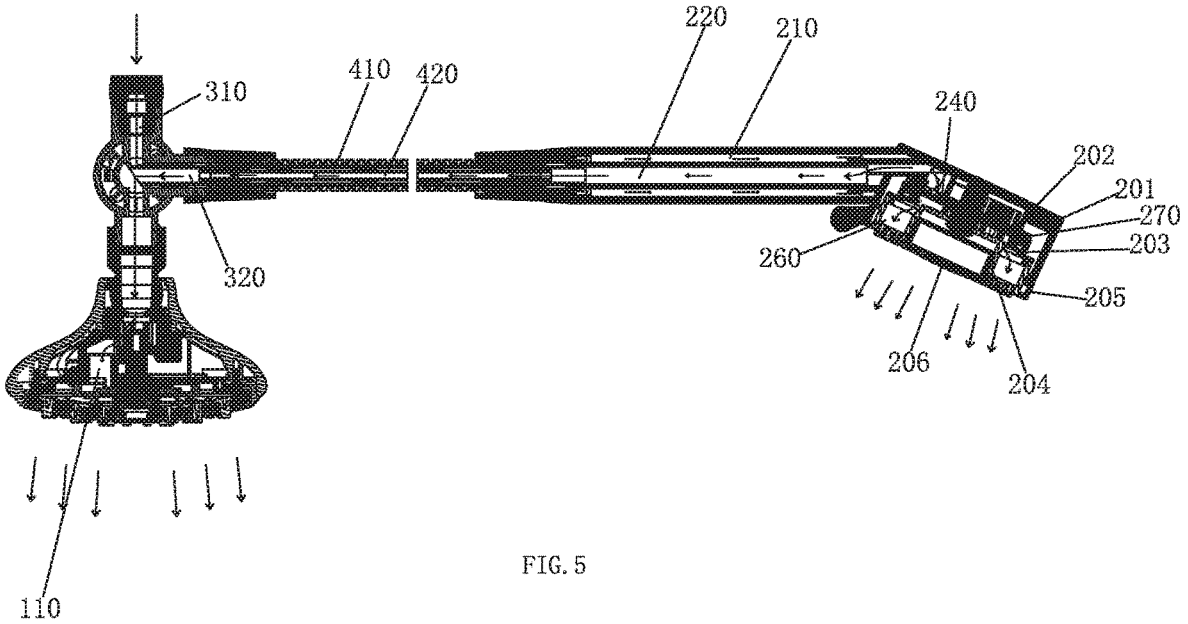
FIG. 5 illustrates a cross-sectional view of the shower device when in a second gearing position.
Figure 6:
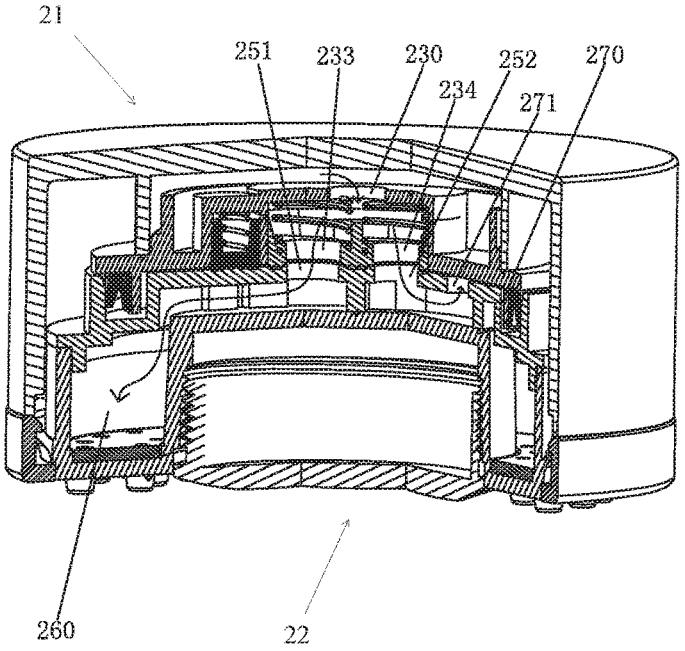
FIG. 6 illustrates a first cross-sectional view of the second shower when in the second gearing position.
Figure 7:
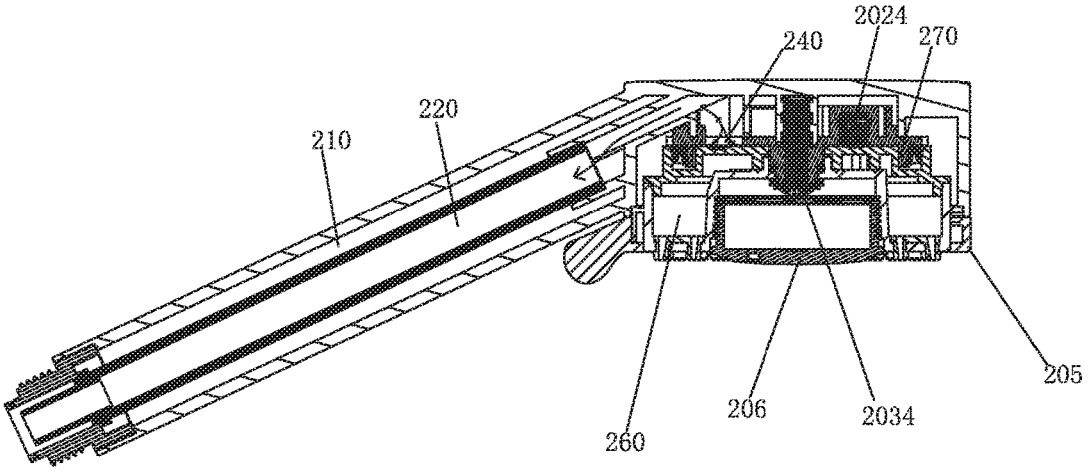
FIG. 7 illustrates a second cross-sectional view of the second shower when in the second gearing position.
Figure 8:
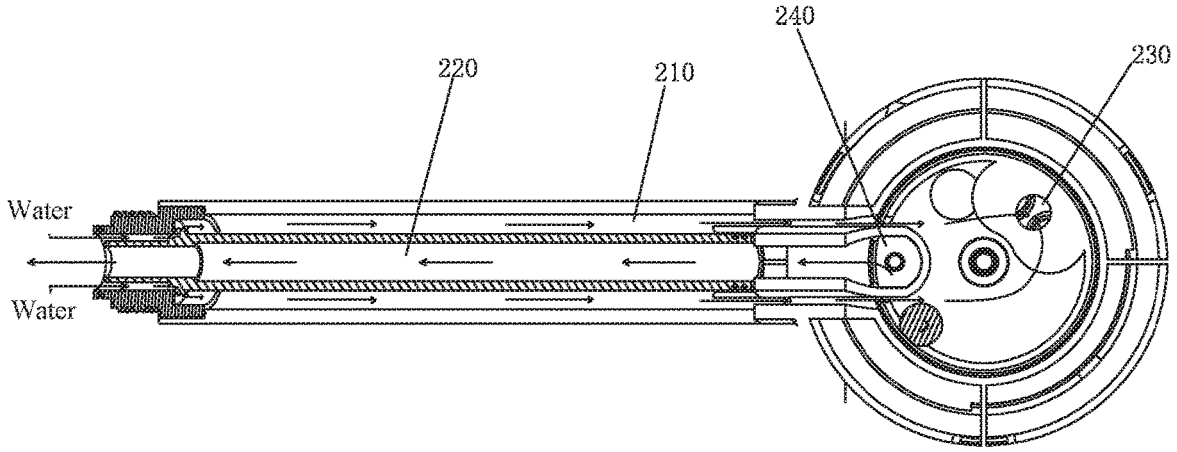
FIG. 8 illustrates a third cross-sectional view of the second shower when in the second gearing position.

Referring to FIGS. 3 and 4, at this time, the gearing position pin 10 is in first gearing position. The first sealing hole 233 couples to the top surface of the water dividing body 203 to be in a sealed state. The second sealing hole 234 aligns with and is in communication with the first water dividing hole 251. Water from the water inlet cavity 310 flows into the joint 300, then flows through the outer flow passage 410 of the connecting pipe 400, the first water passage 210 of the second shower 200, the first water hole 230, the second sealing hole 234, and the first water dividing hole 251, then flows into the second water outlet passage 260, and then the water flows out of the second shower 200.

The adjusting ring 205 rotates to drive the water outlet panel 204 and the water dividing body 203 to rotate synchronously until the gearing position pin 10 is in the second gearing position. At this time, the first sealing hole 233 aligns with and is in communication with the first water dividing hole 251, and the second sealing hole 234 aligns with and is in communication with the second water dividing hole 252. Water from the water inlet cavity 310 flows into the joint 300, then flows through the outer flow passage 410 of the connecting pipe 400, the first water passage 210 of the second shower 200, and the first water hole 230, and then flows into the guide groove 235 of the sealing pad 232. The water in the guide groove 235 is divided into two paths, the water in a first path of the two paths flows from the first sealing hole 233, flows through the first water dividing hole 251, flows into the second water outlet passage 260, and then flows out of the second shower 200. The water in a second path of the two paths flows from the second sealing hole 234, flows into the second water dividing hole 252 and the through hole 271, then flows into the flow gap 270, then flows from the second water hole 240, flows into the second water passage 220, then flows into the inner flow passage 420 of the connecting pipe 400, the water outlet cavity 320, and the first water outlet passage 110, and then flows out of the first shower 100. In the second gearing position, referring to FIGS. 5-8, the water flows out of two showers (the first shower 100 and the second shower 200) concurrently.

Figure 9:
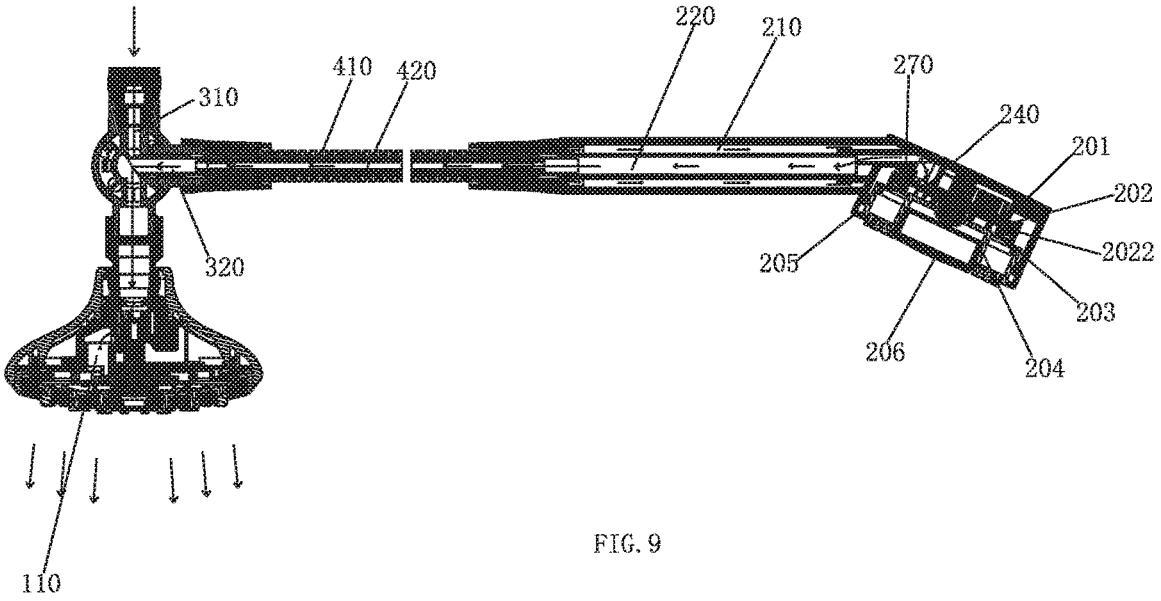
FIG. 9 illustrates a cross-sectional view of a third waterway of the shower device when in a third gearing position.
Figure 10:
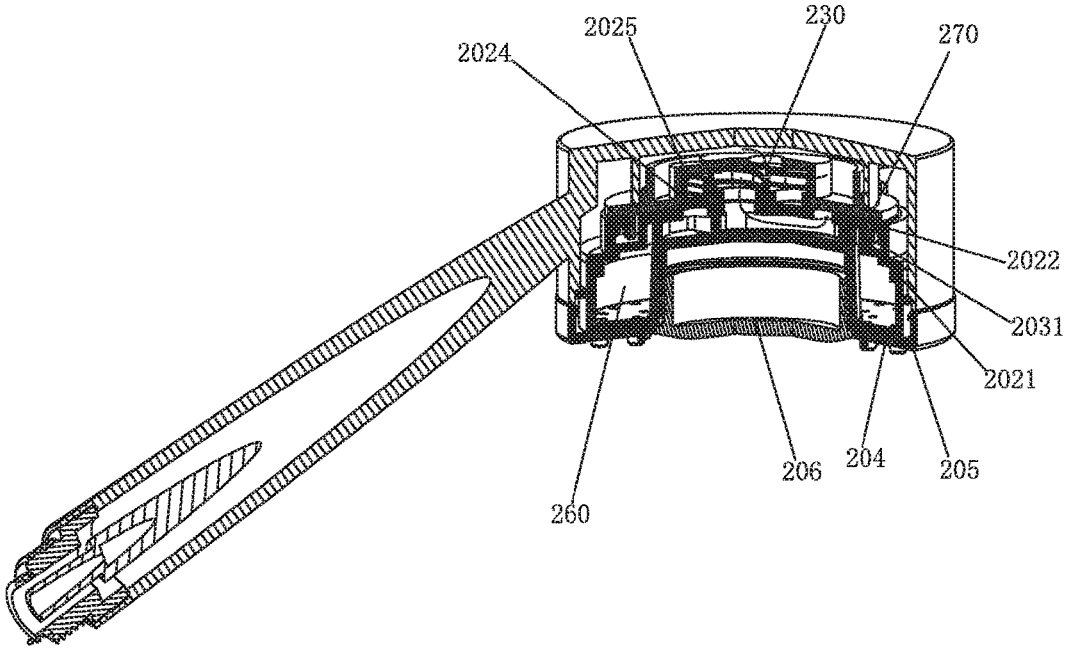
FIG. 10 illustrates a cross-sectional view of the second shower when in the third gearing position.
Figure 11:
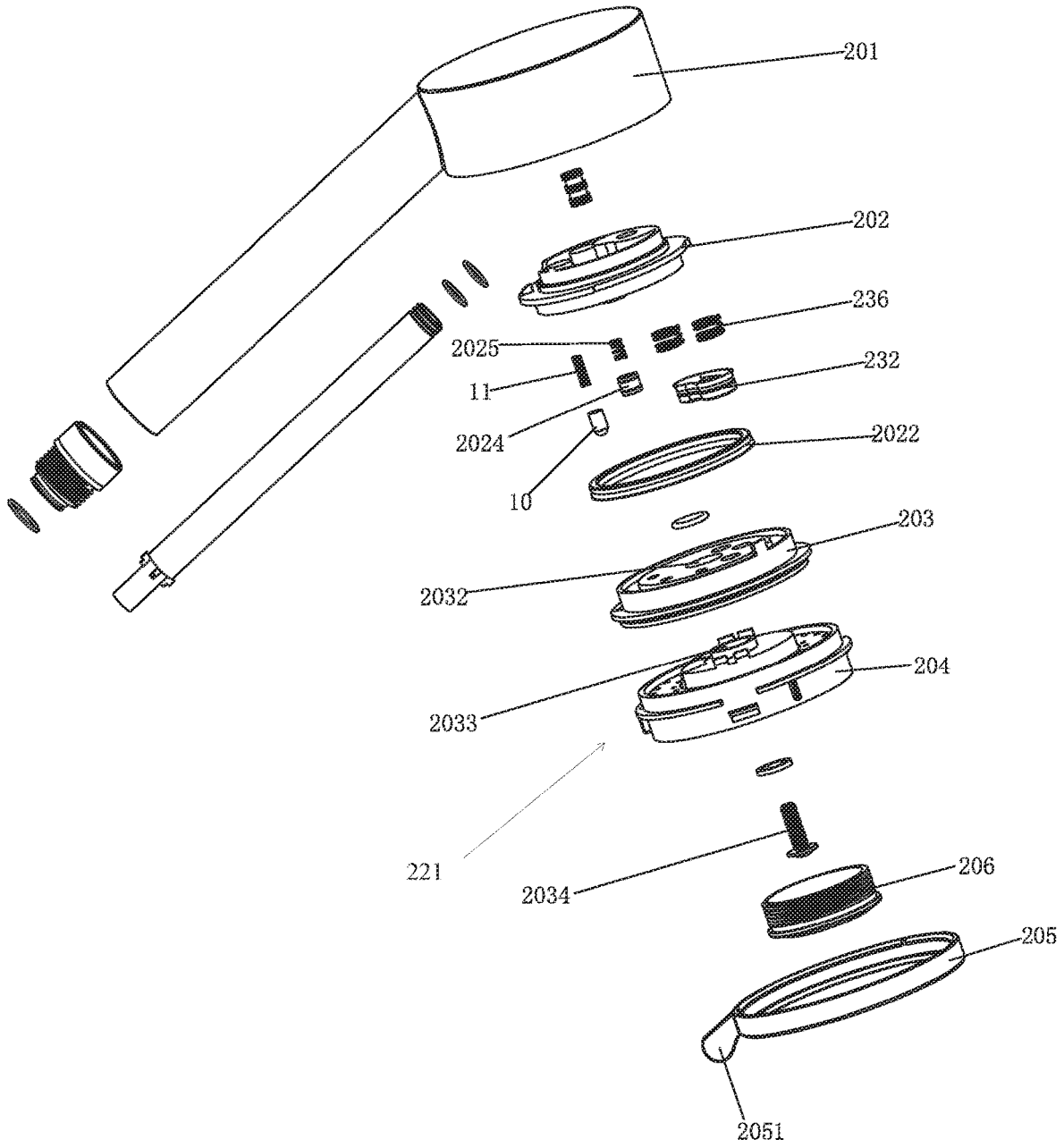
FIG. 11 illustrates an exploded perspective view of the second shower.
Figure 12:
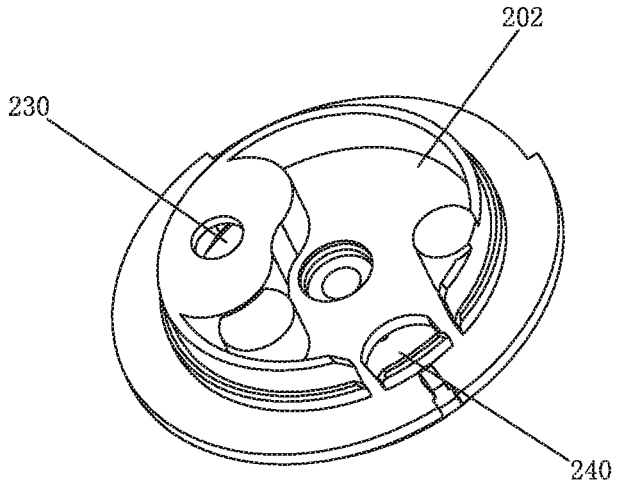
FIG. 12 illustrates a first perspective view of an adjusting sheet.

Referring to FIGS. 9 and 10, the adjusting ring 205 continues to rotate to drive the water outlet panel 204 and the water dividing body 203 to rotate synchronously until the gearing position pin 10 is in the third gearing position. At this time, the first sealing hole 233 aligns with and is in communication with the second water dividing hole 252. The first water dividing hole 251 is sealed and stops discharging water due to the water stopping pad 2024. The water from the water inlet cavity 310 flows into the joint 300, then flows through the outer flow passage 410 of the connecting pipe 400, the first water passage 210 of the second shower 200, and the first water hole 230, and then flows into the guide groove 235 of the sealing pad 232. The water in the guide groove 235 flows through the first sealing hole 233, the second water dividing hole 252, and the through hole 271, flows into the flow gap 270, then the water flows from the second water hole 240, flows into the second water passage 220, then flows into the water outlet cavity 320 and the first water outlet passage 110, and then flows out of the first shower 100.

The aforementioned embodiments are merely some embodiments of the present disclosure, and the scope of the disclosure of is not limited thereto. Thus, it is intended that the present disclosure cover any modifications and variations of the presently presented embodiments provided they are made without departing from the appended claims and the specification of the present disclosure.

What is claimed is:

1. A shower device, comprising:
a first shower with a first water outlet passage,
a joint,
a second shower, and
a connecting pipe, wherein:
the joint is fixedly connected to the first shower,
the joint comprises a water inlet cavity and a water outlet cavity,
the first water outlet passage is in communication with the water outlet cavity,
the second shower comprises a second shower fixed portion and a rotation switching portion,
the second shower fixed portion comprises a first water passage, a second water passage disposed in the first water passage, a first water hole in communication with the first water passage, and a second water hole in communication with the second water passage,
the rotation switching portion is rotatably connected to the second shower fixed portion,
the rotation switching portion comprises at least two water dividing holes and a second water outlet passage,
a flow gap in communication with the second water passage is defined between the second shower fixed portion and the rotation switching portion,
a first one of the at least two water dividing holes is in communication with the second water outlet passage,
a second one of the at least two water dividing holes and the second water hole are in communication with the flow gap,
the rotation switching portion rotates to enable the first water hole to be switched to be in communication with at least one of the at least two water dividing holes,
the connecting pipe comprises an outer flow passage and an inner flow passage disposed in the outer flow passage,
two ends of the connecting pipe are respectively fixedly connected to the joint and the second shower fixed portion,
the outer flow passage is in communication with the water inlet cavity and the first water passage, and
the inner flow passage is in communication with the second water passage and the water outlet cavity.

2. The shower device according to claim 1, comprising:
a sealing pad, wherein:
the second shower fixed portion comprises a second shower body and an adjusting sheet fixedly disposed in the second shower body,
the first water passage and the second water passage are both disposed on the second shower body,
the first water hole and the second water hole are both disposed on the adjusting sheet,
a bottom surface of the adjusting sheet comprises a mounting groove in communication with the first water hole,
the sealing pad is hermetically coupled in the mounting groove,
a bottom surface of the sealing pad comprises one or more sealing holes, and
the rotation switching portion rotates to enable the one or more sealing holes to align with and be in communication with at least one of the at least two water dividing holes or to be staggered with at least one of the at least two water dividing holes to be sealed.

3. The shower device according to claim 2, wherein:
the rotation switching portion comprises a water dividing body disposed below the adjusting sheet and a water outlet panel assembly fixedly connected to the water dividing body,
the at least two water dividing holes comprise two water dividing holes, the two water dividing holes respectively define a first water dividing hole and a second water dividing hole and are disposed on the water dividing body, the second water outlet passage is disposed on the water outlet panel assembly, the water dividing body comprises a through hole in communication with the flow gap, and a bottom surface of the water dividing body further comprises a connecting groove configured to be in communication with the second water dividing hole and the through hole.

4. The shower device according to claim 3, comprising:

a sealing ring, wherein:

the bottom surface of the adjusting sheet protrudes downward to define a protruding ring, a top surface of the water dividing body comprises an annular groove, the protruding ring is disposed in the annular groove, the sealing ring is hermetically sandwiched between the protruding ring and a groove wall of the annular groove, the adjusting sheet further comprises a receiving groove, a water stopping pad and a water stopping elastic member are disposed in the receiving groove, two ends of the water stopping elastic member abut and are disposed between a top wall of the receiving groove and the water stopping pad, and when the first water dividing hole is staggered with the one or more sealing holes:

the water stopping pad hermetically abuts a position of the first water dividing hole, and the flow gap is defined between the sealing ring, the adjusting sheet, the water dividing body, and the water stopping pad.

5. The shower device according to claim 4, comprising:

a lock bolt, wherein:

the bottom surface of the adjusting sheet protrudes to define a hollow rotation shaft, the water dividing body and the water outlet panel assembly are respectively disposed with a first shaft hole and a second shaft hole, the hollow rotation shaft is disposed in the first shaft hole and the second shaft hole, the hollow rotation shaft rotatably cooperates with the first shaft hole and the second shaft hole, the lock bolt passes through the hollow rotation shaft, a head end of the lock bolt abuts an outer side of the hollow rotation shaft, and the lock bolt is screwed to the second shower fixed portion to enable the water dividing body, the water outlet panel assembly, and the second shower fixed portion to be relatively fixed axially.

6. The shower device according to claim 4, comprising:

a gearing position pin, and a gearing position elastic member, wherein:

the adjusting sheet further comprises a gearing position cavity, a guide column is disposed in the gearing position cavity, the gearing position pin surrounds an outer side of the guide column, the gearing position elastic member is disposed between the gearing position pin and the guide column, two ends of the gearing position elastic member abut and are disposed between the gearing position cavity and the gearing position pin, and the top surface of the water dividing body comprises a plurality of gearing position slots configured to cooperate with the gearing position pin.

7. The shower device according to claim 4, wherein:

the water outlet panel assembly comprises a water outlet panel, an adjusting ring, and a decorative cover, the adjusting ring surrounds an outer side of the water outlet panel, the decorative cover is connected to and covers a center of the water outlet panel, and the adjusting ring is disposed with a dial.

8. The shower device according to claim 2, comprising:

one or more sealing elastic members, wherein:

the number of the one or more sealing elastic members is equal to the number of the one or more sealing holes, a top portion of the sealing pad comprises a guide groove in communication with all of the one or more sealing holes, and each of the one or more sealing elastic members abuts and is disposed between a corresponding one of the one or more sealing holes and a groove wall of the mounting groove.

9. The shower device according to claim 1, wherein the first shower is a top shower, and the second shower is a handheld shower.

* * * * *